US007342578B2

(12) United States Patent
Joo

(10) Patent No.: US 7,342,578 B2
(45) Date of Patent: Mar. 11, 2008

(54) METHOD AND APPARATUS FOR DRIVING DISPLAY PANEL

(75) Inventor: Mi-Young Joo, Asan-si (KR)

(73) Assignee: Samsung SDI Co., Ltd., Suwon (KR)

( * ) Notice: Subject to any disclaimer, the term of this patent is extended or adjusted under 35 U.S.C. 154(b) by 629 days.

(21) Appl. No.: 10/992,197

(22) Filed: Nov. 19, 2004

(65) Prior Publication Data

US 2005/0116893 A1 Jun. 2, 2005

(30) Foreign Application Priority Data

Nov. 29, 2003 (KR) ..... 10-2003-0086057

(51) Int. Cl.
*G09G 5/00* (2006.01)

(52) U.S. Cl. ..... 345/211; 345/63; 345/690

(58) Field of Classification Search ..... 345/211, 345/690, 63, 60
See application file for complete search history.

(56) References Cited

U.S. PATENT DOCUMENTS 5,541,618 A 7/1996 Shinoda
7,095,888 B2 * 8/2006 Kim ..... 382/162
7,161,607 B2 * 1/2007 Choi ..... 345/690
2002/0175922 A1 * 11/2002 Koo et al. ..... 345/589
2002/0195963 A1 * 12/2002 Tokunaga et al. ..... 315/169.3
2003/0169217 A1 * 9/2003 Kang et al. ..... 345/63

FOREIGN PATENT DOCUMENTS

KR 10-2002-0094712 12/2002

* cited by examiner

*Primary Examiner*—Kent Chang
(74) *Attorney, Agent, or Firm*—H.C. Park & Associates, PLC

(57) ABSTRACT

A display panel driving method and apparatus including a subfield generator converting input image data into subfield data; a determination unit detecting the number of inversions from the subfield data, determining whether an address power increases according to a calculation result, and outputting a determination result as a control signal; a storage unit delaying the input image data during one frame; and a gain controller applying a gain to the image data input from the storage unit, according to the number of inversions and in response to the control signal.

15 Claims, 6 Drawing Sheets

| | $A_I$ | SUBFIELD ARRANGEMENT | | | | | | | |
|---|---|---|---|---|---|---|---|---|---|
| | | 128 | 64 | 32 | 16 | 8 | 4 | 2 | 1 |
| $Y_1$ | 192 | 1 | 1 | 0 | 0 | 0 | 0 | 0 | 0 |
| $Y_2$ | 193 | 1 | 1 | 0 | 0 | 0 | 0 | 0 | 1 |
| $Y_3$ | 194 | 1 | 1 | 0 | 0 | 0 | 0 | 1 | 0 |
| $Y_4$ | 195 | 1 | 1 | 0 | 0 | 0 | 0 | 1 | 1 |
| $Y_5$ | 196 | 1 | 1 | 0 | 0 | 0 | 1 | 0 | 0 |
| $Y_6$ | 197 | 1 | 1 | 0 | 0 | 0 | 1 | 0 | 1 |
| $Y_7$ | 198 | 1 | 1 | 0 | 0 | 0 | 1 | 1 | 0 |
| $Y_8$ | 199 | 1 | 1 | 0 | 0 | 0 | 1 | 1 | 1 |

METHOD AND APPARATUS FOR DRIVING DISPLAY PANEL

CROSS REFERENCE TO RELATED APPLICATION

This application claims priority to and the benefit of Korean Patent Application No. 10-2003-0086057, filed on Nov. 29, 2003, which is hereby incorporated by reference for all purposes as if fully set forth herein.

BACKGROUND OF THE INVENTION

1. Field of the Invention

The present invention relates to a method and apparatus for driving a display panel. More specifically, the present invention relates to a method and apparatus for driving a display panel with controlled address power.

2. Discussion of the Related Art

FIG. 1 shows a structure of a conventional three-electrode surface-discharge type plasma display panel (PDP). Referring to FIG. 1, address electrode lines $A_1, A_2, \ldots, A_m$, dielectric layers 102 and 110, Y-electrode lines $Y_1, \ldots, Y_n$, X-electrode lines $X_1, \ldots, X_n$, a phosphor layer 112, partition walls 114, and a protective layer 104 are disposed between front and rear glass substrates 100 and 106 of a conventional surface-discharge PDP 1.

The address electrode lines $A_1, A_2, \ldots, A_m$ are formed on a front side of the rear glass substrate 106 and covered by the lower dielectric layer 110. Partition walls 114, which partition off a discharge area of each display cell and prevent optical cross-talk between display cells, are formed on the lower dielectric layer 110 in parallel to the address electrode lines $A_1, A_2, \ldots$, and $A_m$. The phosphor layer 112 is formed on the lower dielectric layer 110 and on the sides of the partition walls 114.

The X-electrode lines $X_1, \ldots, X_n$ and the Y-electrode lines $Y_1, \ldots, Y_n$ are formed on a rear side of the front glass substrate 100 to be orthogonal to the address electrode lines $A_1, A_2, \ldots, A_m$. Intersections of the address electrode lines $A_1, A_2, \ldots, A_m$ and the X-electrode lines $X_1, \ldots, X_n$ and the Y-electrode lines $Y_1, \ldots, Y_n$ form discharge cells. The X-electrode lines $X_1, \ldots, X_n$ and the Y-electrode lines $Y_1, \ldots, Y_n$ are formed having transparent electrode portions $X_{na}$ and $Y_{na}$ and metallic electrode portions $X_{nb}$ and $Y_{nb}$. The front dielectric layer 102 covers the X-electrode lines $X_1, \ldots, X_n$ and the Y-electrode lines $Y_1, \ldots, Y_n$. The protective layer 104, which protects the PDP 1 from a strong electric field, may be a MgO layer covering the front dielectric layer 102. A gas for forming plasma is sealed in a discharge space 108.

A conventional PDP driving method includes sequentially performing reset, address, and display sustain steps for a unit subfield. In the reset step, display cell charge states are made uniform. The addressing step sets charge states of for selected and non-selected display cells. In the display sustain step, display discharge is performed in selected display cells.

FIG. 2 shows a structure of a conventional apparatus for driving the PDP 1 of FIG. 1. Referring to FIG. 2, the conventional apparatus may include an image processor 200, a logic controller 202, an address driver 206, an X-driver 208, and a Y-driver 204. The image processor 200 converts an external image signal into a digital signal and generates internal image signals, including 8-bit red (R), green (G), and blue (B) image data, a clock signal, and vertical and horizontal synchronous signals. The logic controller 202 generates driving control signals $S_A$, $S_Y$, and $S_X$ in response to the internal image signal inputted from the image processor 200. The address driver 206 processes the address signal $S_A$ to generate and apply display data signals to address electrode lines. The X-driver 208 processes the X-driving control signal $S_X$ and applies the result to the X-electrode lines. The Y-driver 204 processes the Y-driving control signal $S_Y$ and applies the result to the Y-electrode lines.

U.S. Pat. No. 5,541,618 discloses an address-display separation driving method for the PDP 1.

FIG. 3 shows a conventional address-display separation driving method of the Y-electrode lines of the PDP 1 of FIG. 1. Referring to FIG. 3, a unit frame may be divided into eight subfields SF1, . . . , SF8 for time division gray-scale display. Each subfield SF1, . . . , SF8 may be further divided into a reset period (not shown), an address period A1, . . . , A8, and a discharge-sustain period S1, . . . , S8.

In the address periods A1, . . . , A8, display data signals are applied to the address electrode lines ($A_1, A_2, \ldots, A_m$ of FIG. 1) and, a corresponding scan pulse is sequentially applied to each Y-electrode line $Y_1, Y_2, \ldots, Y_n$.

In the discharge-sustain periods S1, . . . , S8, display-discharge pulses are alternately applied to the Y-electrode lines $Y_1, Y_2, \ldots, Y_n$ and X-electrode lines $X_1, X_2, \ldots, X_n$ to perform display discharges in selected discharge cells.

The PDP's luminance is proportional to the number of discharge-sustain pulses in the discharge-sustain periods S1, . . . , S8 of the unit frame. When one frame used in forming one image is represented as eight subfields and a 256 level gray scale as shown in FIG. 3, different numbers of sustain pulses may be allocated to each subfield at the rates of 1, 2, 4, 8, 16, 32, 64, and 128. Therefore, in order to realize the luminance of a 133 level gray scale, cells may be addressed and discharge sustained for a first subfield period, a third subfield period, and an eighth subfield period.

The number of sustain pulses allocated to each subfield may vary according to weighted values of the subfields in an automatic power control (APC) step. Additionally, the number of sustain pulses allocated to each subfield may be modified considering gamma characteristics or panel characteristics. For example, a gray scale allocated to a fourth subfield may be reduced from 8 to 6, and a gray scale allocated to a sixth subfield may be increased from 32 to 34. Additionally, the number of subfields used in forming one frame may change according to design specifications.

FIG. 4 is a block diagram showing a conventional address APC apparatus. The APC apparatus includes a pixel difference adder 400, a storage unit 402, a gain table 404, and a gain controller 406. The pixel difference adder 400 adds pixel differences, i.e., differences ($A_{j,i+1}-A_{j,i}$) between gray scales of a current and previous pixel in each vertical line in one frame and outputs an addition result. The storage unit 402 delays the input image data IN during one frame. The gain controller 406 multiplies the image data input from the storage unit 402 by a predetermined weighted value, which is obtained by referring to an output of the pixel difference adder 400 and the gain table 404.

Consequently, the conventional address APC unit of FIG. 4 may detect an address power increase for a large sum of pixel differences in each vertical line in one frame, and then multiply the image data by a reduced weighted value to prevent the power increase.

However, the above-described method may not reduce address power in the case of input image data as shown in FIG. 5. In FIG. 5, in a j-th vertical line $A_j$, there is a small difference between pixels because the image data has values of 192, 193, 194, . . . Thus, with image data having this pattern, an output value of the pixel difference adder 400 of FIG. 4 is may be small, which may result in little difference in weighted values in the address APC step.

However, as shown in FIG. 6, if the image data having this pattern is changed into subfield data, the number of inversions (1→0, 0→1) during addressing may be large, which increases address power. But the conventional address APC step may not be performed on the image data having this pattern.

SUMMARY OF THE INVENTION

The present invention provides a method and apparatus for driving a display panel that is capable of detecting a pattern that is a substantial factor of an increased address power and performing address power control according to the detection result.

Additional features of the invention will be set forth in the description which follows, and in part will be apparent from the description, or may be learned by practice of the invention.

The present invention discloses an apparatus for driving a display panel, comprising a subfield generator converting input image data into subfield data, and a determination unit calculating a number of inversions from the subfield data, determining whether or not an address power increases according to a calculation result, and outputting a determination result as a control signal. A storage unit delays the input image data during one frame, and a gain controller applies a gain according to the number of inversions to the image data input from the storage unit, in response to the control signal.

The present invention also discloses an apparatus for driving a display panel, comprising a subfield generator converting input image data into subfield data, and a determination unit calculating a number of inversions from the subfield data, determining whether or not an address power increases according to a calculation result, and outputting a determination result as a control signal. A storage unit delays the subfield data during one frame, and a subfield correction unit corrects a subfield so that the number of inversions is reduced from the subfield data output from the storage unit, in response to the control signal.

The present invention also discloses a method for driving a display panel, comprising converting image data into subfield data, determining a number of inversions from the subfield data, determining whether an address power increases due to the number of inversions, and altering the image data based on the number of inversions.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

DETAILED DESCRIPTION OF THE ILLUSTRATED EMBODIMENTS

Hereinafter, a method and an apparatus for driving a display panel according to exemplary embodiments of the present invention will be described with reference to the accompanying drawings.

The present invention's basic, panel-driving concept is to determine the size of an address power by detecting a pattern that is a substantial factor of increased address power, rather than simply determining the size of an address power by adding differences between address data during one frame.

Figure 5:
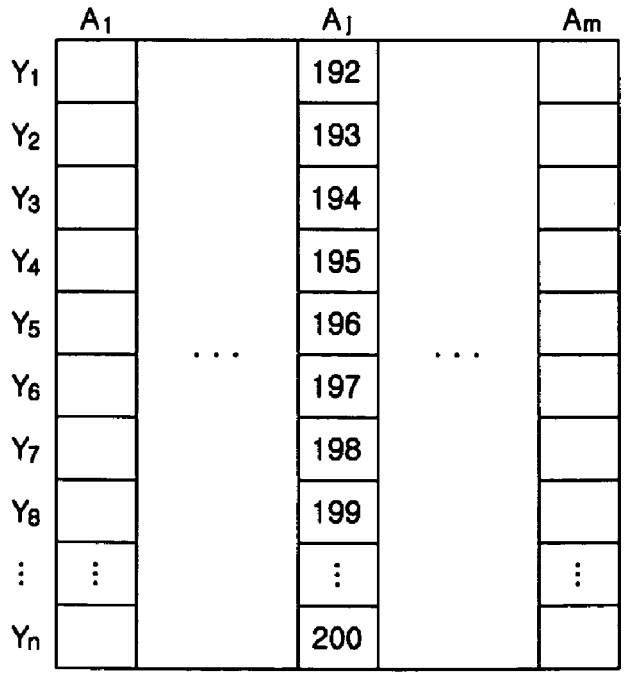
FIG. 5 shows an example of image data input into an apparatus for driving a display panel according to exemplary embodiments of the present invention.
Figures 6, 7:
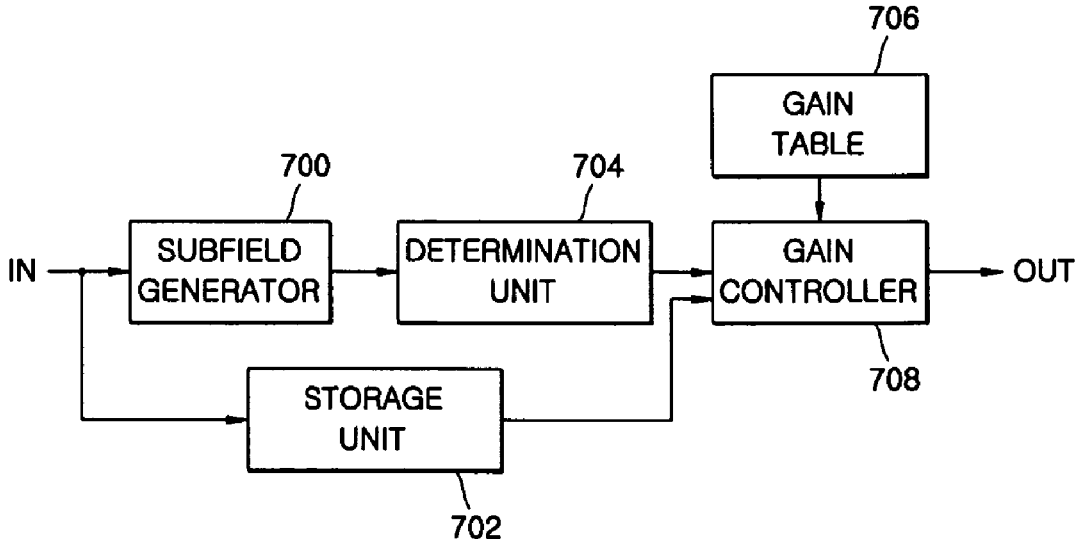
FIG. 6 is a table showing image data of FIG. 5 that is changed into subfield data.
FIG. 7 is a block diagram of an apparatus for driving a display panel with address APC according to an exemplary embodiment of the present invention.

In FIG. 5, in the j-th vertical line $A_j$, as noted above, there is a small difference between pixels because image data has values of 192, 193, 194, . . . , which may result in little difference to weighted values in a conventional address APC step. However, as shown in FIG. 6, changing the image data into subfield data may produce a large number of inversions (1→0, 0→1) during addressing, which increases an address power. Thus, exemplary embodiments of the present invention detect the number of subfield data inversions to detect a pattern of a large address power.

Inversion means that data changes from 1→0 or 0→1 between vertically aligned pixels. Additionally, the number of subfield data inversions is the sum of numbers inverted in one subfield.

The apparatus for driving a display panel according to exemplary embodiments of the present invention controls the gain of image data according to the detected number of inversions.

FIG. 7 is a block diagram of an apparatus for driving a display panel for address APC according to an exemplary embodiment of the present invention. The apparatus of FIG. 7 includes a subfield generator 700, a determination unit 704, a storage unit 702, a gain table 706, and a gain controller 708.

The subfield generator 700 converts input image data IN into subfield data.

The determination unit 704 calculates the number of inversions from the subfield data, determines whether an address power increases according to a calculation result, and outputs a determination result as a control signal.

The storage unit 702 delays the input image data IN for one frame.

The gain controller 708 multiplies the image data input from the storage unit 702 by a predetermined gain value, which may be obtained by referring to the control signal of the determination unit 704 and to the gain table 706. The gain table 706 stores gain values, which may be less than 1.

Table 1 shows changes in subfields of FIG. 6 and changes in the number of inversions when a weighted value is changed into a value less than 1.

TABLE 1

| | X 1 | X 0.9 | X 0.8 | X 0.7 | X 0.6 | X 0.5 |
|---|---|---|---|---|---|---|
| 192 | 11000000 | 10101101 | 10011010 | 10000110 | 01110011 | 01100000 |
| 193 | 11000001 | 10101110 | 10011010 | 10000111 | 01110100 | 01100001 |
| 194 | 11000010 | 10101111 | 10011011 | 10001000 | 01110100 | 01100001 |
| 195 | 11000011 | 10110000 | 10011100 | 10001001 | 01110101 | 01100010 |
| 196 | 11000100 | 10110000 | 10011101 | 10001001 | 01110110 | 01100010 |
| 197 | 11000101 | 10110001 | 10011110 | 10001010 | 01110110 | 01100011 |
| 198 | 11000110 | 10110010 | 10011110 | 10001011 | 01110111 | 01100011 |
| 199 | 11000111 | 10110011 | 10011111 | 10001011 | 01110111 | 01100100 |
| Number of inversions | 11 times | 12 times | 8 times | 9 times | 7 times | 7 times |

Table 1 shows that if a gain value is 1, the detected number of inversions is 11, and if the gain value changes in the order of 1→0.9→0.8→0.7→0.6→0.5, the number of inversions changes in the order of 11→12→8→9→7→7, respectively. Thus, the gain table 706 may be set so that the gain value is 0.6 when the detected number of inversions is 11. In this way, a predetermined gain table for the number of inversions may be established, and the gain of image data may be controlled to reduce the number of inversions.

In this case, if the lowermost bits are set to 0 and the gain value changes in the order of 1→0.9→0.8→0.7→0.6→0.5, the number of inversions changes in the order of 4→6→3→4→3→3, respectively. In this case, the gain value may be set to 0.8.

Figure 8:
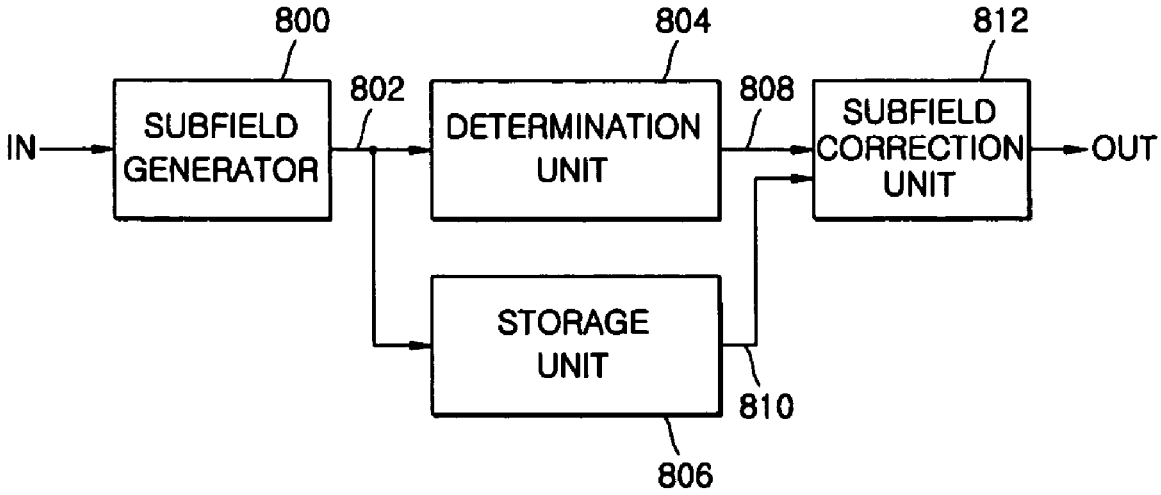
FIG. 8 is a block diagram of an apparatus for driving a display panel with address APC according to another exemplary embodiment of the present invention.

FIG. 8 is a block diagram of an apparatus for driving a display panel for address APC according to another exemplary embodiment of the present invention. The apparatus of FIG. 8 includes a subfield generator 800, a determination unit 804, a storage unit 806, and a subfield correction unit 812.

The subfield generator 800 converts input image data IN into subfield data 802. For example, the subfield generator 800 may convert input image data in a j-th vertical line $A_j$, as shown FIG. 6.

The determination unit 804 detects the number of inversions from the subfield data 802, determines whether an address power increases according to a calculation result, and outputs a determination result as a control signal 808.

The storage unit 806 delays the subfield data during one frame and outputs the subfield data 810 to the subfield correction unit 812.

The subfield correction unit 812 corrects a subfield to reduce the number of inversions from the subfield data 810, in response to the control signal 808. In other words, the subfield correction unit 812 outputs a corrected subfield having a reduced number of inversions as compared to the subfield data output 810 from the storage unit 806.

To this end, the subfield correction unit 812 may change the subfield having more than a predetermined number of inversions to reduce the number of inversions. In other words, part of the subfield data that inverts from 0→1 or 1→0 may be changed to 0→0 or 1→1 so that it does not invert. The subfield correction unit 812 may also turn off or on all data in the subfield having more than the predetermined number of inversions. The subfield corrected to have fewer inversions may be limited to a subfield having the least gray-scale weight, which may minimize image distortion. For example, in FIG. 6, the greatest number of inversions is detected in a subfield having the least gray-scale weight, and all data in that subfield may be changed into 0 or 1, which would reduce the number of inversions from 11 to 4 and effectively minimize the distortion of data.

The subfield correction unit 812 may also omit a subfield having the most number of inversions. The omitted subfield may be a subfield having the least gray-scale weight, so as to minimize image distortion caused by the omission. For example, in FIG. 6, the most number of inversions is detected in the subfield having the least gray-scale weight, and that subfield may be omitted.

Figure 1:
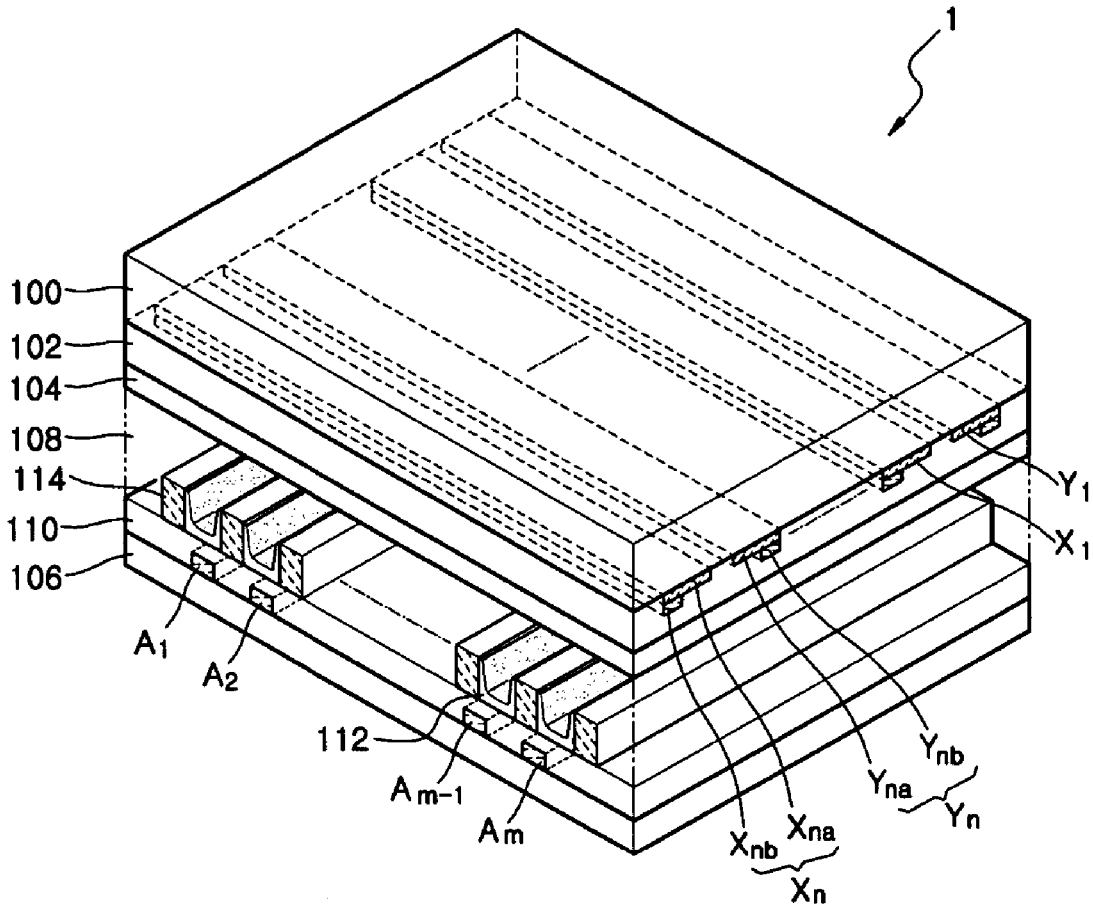
FIG. 1 (RELATED ART)
FIG. 1 shows a structure of a conventional three-electrode surface-discharge type PDP.
Figure 2:
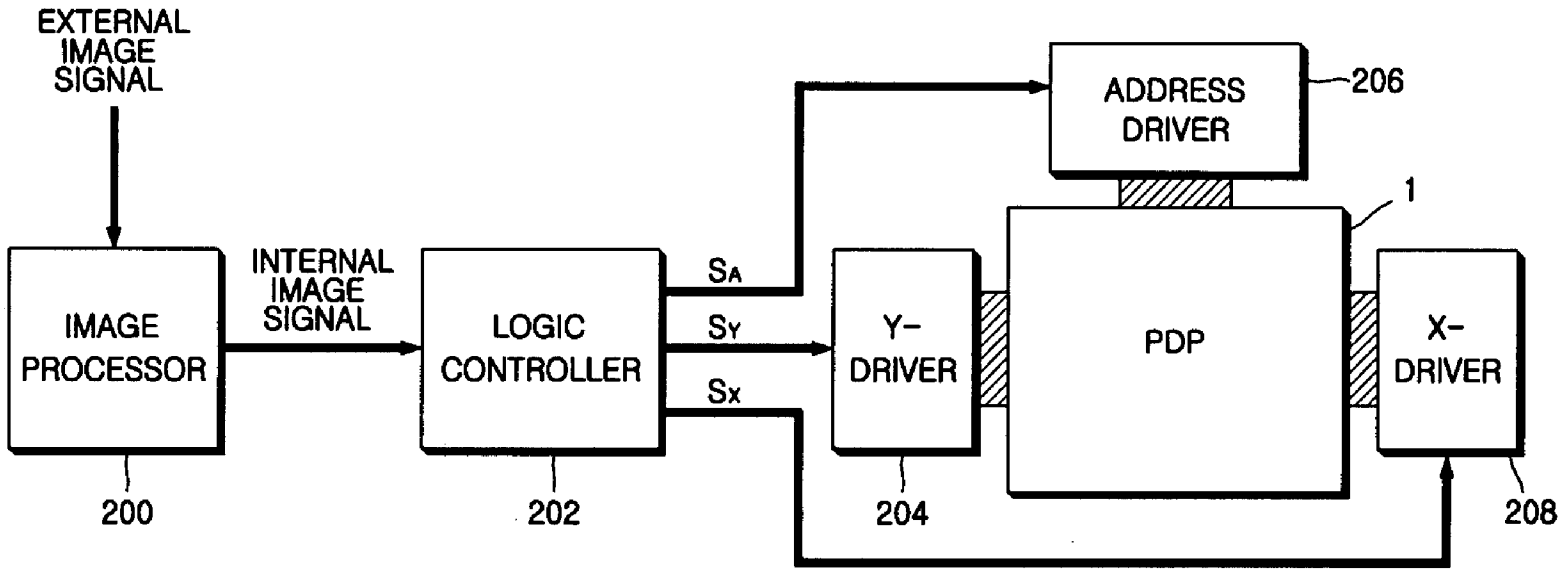
FIG. 2 (RELATED ART)
FIG. 2 shows a structure of a conventional apparatus for driving the PDP of FIG. 1.
Figure 3:
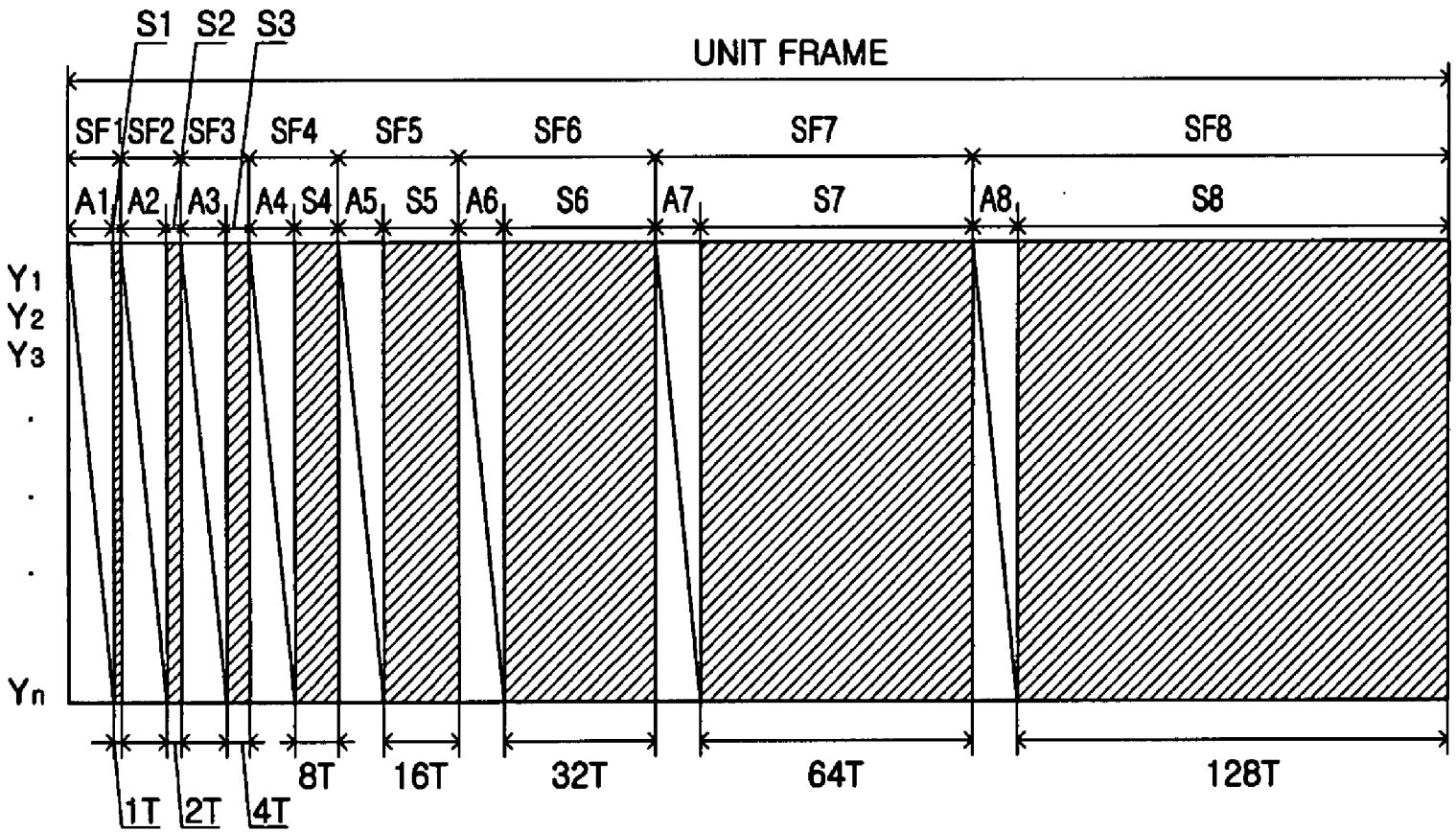
FIG. 3 (RELATED ART)
FIG. 3 shows a conventional address-display separation driving method for the Y-electrode lines of the PDP of FIG. 1.
Figure 4:
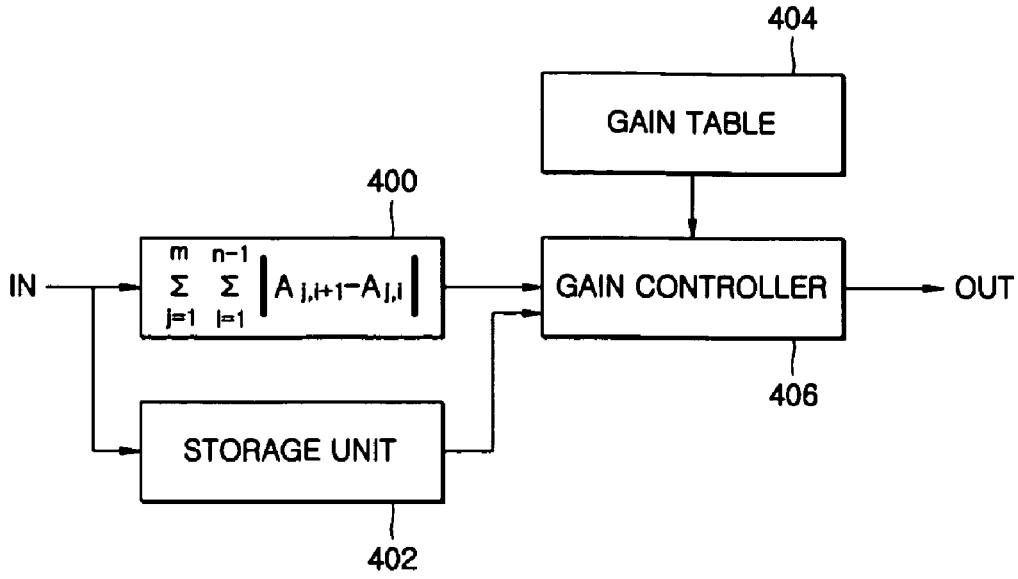
FIG. 4 (RELATED ART)
FIG. 4 is a block diagram showing a conventional address APC apparatus.

The apparatus for driving a display panel according to exemplary embodiments of the present invention may be implemented as a logic circuit using an integrated circuit, which is written by schematic or VHDL on a computer, is connected to the computer and is programmable, for example, a field programmable gate array (FPGA), or may be implemented to be included in the logic controller 202 of FIG. 2, for example, when the apparatus is applied to a plasma display panel (PDP).

As described above, in the method and apparatus for driving a display panel according to the present invention, a pattern that is a substantial factor of increased address power is detected, thereby performing address power control.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. An apparatus for driving a display panel, comprising:

a subfield generator converting input image data into subfield data;

a determination unit calculating a number of inversions from the subfield data, determining whether an address power increases according to the calculation, and outputting a determination result as a control signal;

a storage unit delaying the input image data during one frame; and a gain controller applying a gain according to the number of inversions to the image data input from the storage unit, in response to the control signal.

2. The apparatus of claim 1, further comprising:

a gain table for storing the gain;

wherein the gain controller obtains the gain by referring to the gain table, in response to the control signal.

3. An apparatus for driving a display panel, comprising:

a subfield generator converting input image data into subfield data;

a determination unit calculating a number of inversions from the subfield data, determining whether an address power increases according to the calculation, and outputting a determination result as a control signal;

a storage unit delaying the subfield data during one frame; and a subfield correction unit correcting a subfield to reduce the number of inversions of the subfield data output from the storage unit, in response to the control signal.

4. The apparatus of claim 3, wherein the subfield correction unit changes the subfield so that a part of inverted subfield data does not invert if the number of inversions is more than a predetermined number, according to an address electrode in a subfield having the least gray-scale weight.

5. The apparatus of claim 3, wherein the subfield correction unit turns off all data in a subfield having more than a predetermined number of inversions.

6. The apparatus of claim 3, wherein the subfield correction unit turns on all data in a subfield having more than a predetermined number of inversions.

7. The apparatus of claim 3, wherein the subfield correction unit omits a subfield having more than a predetermined number of inversions.

8. The apparatus of claim 7, wherein the omitted subfield is a subfield having a least gray-scale weight.

9. A method for driving a display panel, comprising:

converting image data into subfield data;

determining a number of inversions from the subfield data;

determining whether an address power increases due to the number of inversions; and altering the image data based on the number of inversions.

10. The method of claim 9, wherein altering the image data comprises multiplying the image data by a gain value determined from the number of inversions.

11. The method of claim 9, wherein altering the image data comprises correcting the subfield data to reduce the number of inversions of the subfield data.

12. The method of claim 11, wherein correcting the subfield data comprises turning on all data in a subfield having more than a predetermined number of inversions.

13. The method of claim 11, wherein correcting the subfield data comprises turning off all data in a subfield having more than a predetermined number of inversions.

14. The method of claim 11, wherein correcting the subfield data comprises omitting a subfield having more than a predetermined number of inversions.

15. The method of claim 14, wherein the omitted subfield is a subfield having a least gray-scale weight.

* * * * *